United States Patent [19]

Rosenthal

[11] 4,430,092

[45] Feb. 7, 1984

[54] SCAVENGING ADDITIVE FOR LEADED AUTOMOTIVE FUEL AND METHOD OF USING SAME

[76] Inventor: Walter Rosenthal, 150 E. 74th St., New York, N.Y. 10021

[21] Appl. No.: 338,556

[22] Filed: Jan. 11, 1982

Related U.S. Application Data

[63] Continuation of Ser. No. 217,044, Dec. 16, 1980, abandoned, which is a continuation of Ser. No. 966,593, Dec. 5, 1978, abandoned.

[51] Int. Cl.[3] ..... C10L 1/20

[52] U.S. Cl. ..... 44/69; 44/79; 252/386

[58] Field of Search ..... 44/69.1, 69, 79; 252/386

[56] References Cited

U.S. PATENT DOCUMENTS 2,364,921 12/1944 Shokal ..... 44/69

*Primary Examiner*—Charles F. Warren
*Assistant Examiner*—Mrs. Y. Harris-Smith

[57] ABSTRACT

A highly effective scavenging additive to a leaded automotive fuel which is substantially free of carcinogenic properties comprises tribromo methane or mixtures of tribromo methane and trichloro methane.

6 Claims, No Drawings

SCAVENGING ADDITIVE FOR LEADED AUTOMOTIVE FUEL AND METHOD OF USING SAME

This is a continuation application of Ser. No. 217,044, filed Dec. 16, 1980, now abandoned which is in turn a continuation application of Ser. No. 966,593, filed Dec. 5, 1978.

BACKGROUND OF THE INVENTION (1) Field of the Invention

The present invention relates to a novel and advantageous additive to fuels for motor vehicles and more particularly to a chemical scavenger additive for fuels containing an anti-knocking lead compound, and to a method of using such additive as scavenger for such leaded fuels.

(2) Description of the Prior Art

To increase the octane number of gasoline alkyl lead anti-knocking fluids are added in amounts up to 4.23 g. of lead per gallon of fuel. This amount of lead corresponds to 4 cc. of tetra-ethyl lead, the most widely used commercial anti-knocking agent. Mixtures of tetra-ethyl lead with tetra-methyl lead or of ethyl trimethyl lead, di-ethyl dimethyl lead and triethyl methyl lead in addition to tetra-ethyl lead and tetra-methyl lead have also been added commercially to gasoline as anti-knocking agents. Such leaded gasoline has proved to yield a gasoline with a high octane number in the most economical manner. However, such gasoline has the disadvantage that small amounts of lead are deposited on combustion in the engine and cause severe damage thereto. Therefore, so-called scavenger additives have been added to the leaded gasoline in order to inhibit such deposit formation. Especially suitable for their scavenger action have proved to be 1,2-ethylene dibromide and mixtures of ethylene dibromide with ethylene dichloride. Large amounts of these ethylene halides are now manufactured for this purpose.

Recently it was found that ethylene dibromide causes cancer in laboratory animals when fed to them in large amounts. Thus it may represent a major health hazard not only to the gasoline station attendants but also to the workers in chemical plants producing such scavenger additives.

SUMMARY OF THE INVENTION

It is one object of the present invention to provide a scavenger additive to leaded motor fuel which additive does not present the health hazard of the heretofore used scavenger additives ethylene dibromide.

Another object of the present invention is to provide a leaded motor fuel with a high octane number containing such a scavenger additive which is substantially free of the health hazards inherent in ethylene dibromide.

A further object of the present invention is to provide an anti-knocking composition comprising alkyl lead compounds and a novel scavenging additive of high efficiency.

Still another object of the present invention is to provide a method of inhibiting lead deposit formation on parts of a motor when using leaded fuel.

Other objects of the present invention and advantageous features thereof will become apparent as the description prodeeds.

In principle the novel and highly effective scavenger additive to leaded motor fuel according to the present invention which satisfactorily replaces ethylene dibromide in such leaded fuel is bromoform, i.e. tribromo methane. This compound has proved to be even more effective than ethylene dibromide because the bromide is more losely bound therein and thus is more readily available for reaction and combination with the lead compounds added as anti-knocking agents to the fuel. Since it contains more bromine than ethylene dibromide, it can be added in smaller amounts. Otherwise it has at lease the same scavenging effect as ethylene dibromide.

It has also been found that mixtures of tribromo methane and trichloro methane, i.e. chloroform are at least as effectively as mixtures of ethylene dibromide and ethylene dichloride. Especially useful has proved to be the addition of tribromo methane or of mixtures of tribromo methane and trichloro methane to leaded aviation fuels.

In carrying out the present invention, tribromo methane is added to the fuel in amounts corresponding to about one third of the amount of the tetra-ethyl lead, tetra-methyl lead, and/or tri-ethyl methyl lead. Tribromo methane contains about 95% of bromine and is liquid at room temperature. It is well miscible with gasoline and the like motor fuels, boils at 150° C., and does not cause liver, kidney, and/or lung damage on inhalation as this is the case with etylene dibromide.

Bromoform, i.e. tribromomethane has previously been used extensively in medicine as a sedative and antitussive agent without any side effects being observed. Tests carried out with this agent as scavenger additive to leaded motor fuels demonstrated its high scavenging effectiveness.

DESCRIPTION OF THE PREFERRED EMBODIMENTS

The following examples serve to illustrate the present invention without, however, limiting the same thereto.

EXAMPLE 1

An anti-knocking additive for increasing the octane number in gasoline comprises 10 parts of tetra-ethyl lead and
2.5 parts of tribromo methane.

EXAMPLE 2

An anti-knocking additive for aviation fuel comprises 10 parts of tetra-ethyl lead,
5 parts of tribromo methane, and
0.5 parts of other additives such as dyes, petroleum solvent, and stability improver.

EXAMPLE 3

An automotive gasoline anti-knocking agent comprises 10 parts of tetra-ethyl lead,
5 parts of tetra-methyl lead,
5 parts of tribromo methane,
3 parts of trichloro methane, and
0.5 parts of other ingredients such as dyes, petroleum solvent, and stability improver.

The compositions as described in Examples 1 to 3 are added to the gasoline in amounts of about 3 cc. to 4 cc. per gallon of fuel in order to increase the octane number by 10 to 15.

Of course, many changes and variations in the composition of the scavenging additive, in the amount added to the gasoline or the anti-knocking composition, and the like may be made by those skilled in the art in accordance with the principles set forth herein and in the claims annexed hereto.

I claim:

1. An anti-knocking composition comprising a tetra-alkyl lead compound and, as scavenging agent, tribromo methane.

2. The anti-knocking composition composition of claim 1, additionally containing trichloro methane.

3. An automotive fuel of a high octane number comprising an automotive fuel, an effective amount of a tetra-alkyl lead compound as anti-knocking agent, and an effective amount of tribromo methane as scavening agent.

4. The automotive fuel of claim 3 which additionally comprises an effective amount of trichloro methane as scavenging additive.

5. A method of increasing the octane number of an automotive fuel, said method comprising using an automotive fuel a fuel containing an effective amount of a tetra-alkyl lead compound as anti-knocking agent and an effective amount of tribromo methane as scavenging agent.

6. The method of claim 5, wherein the fuel additionally contains an effective amount of trichloro methane as an additional scavenging agent.

* * * * *